US007751728B2

(12) United States Patent
Okabe

(10) Patent No.: US 7,751,728 B2
(45) Date of Patent: Jul. 6, 2010

(54) IMAGE FORMING APPARATUS AND DEVELOPER CARTRIDGE HAVING LIGHT TRANSMITTING PORTION TO ALLOW AMOUNT OF DEVELOPER TO BE DETECTED

(75) Inventor: Yasushi Okabe, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 667 days.

(21) Appl. No.: 11/675,672

(22) Filed: Feb. 16, 2007

(65) Prior Publication Data

US 2007/0196114 A1 Aug. 23, 2007

(30) Foreign Application Priority Data

Feb. 17, 2006 (JP) ..... P2006-041250

(51) Int. Cl.
*G03G 15/08* (2006.01)

(52) U.S. Cl. ..... 399/27; 399/64

(58) Field of Classification Search ..... 399/13, 399/27, 64, 119; 118/691, 694; 340/612, 340/617; 356/436; 250/573, 575, 577
See application file for complete search history.

(56) References Cited

U.S. PATENT DOCUMENTS

| | | | | |
|---|---|---|---|---|
| 4,646,679 | A * | 3/1987 | Ohno et al. | 118/691 |
| 5,589,918 | A * | 12/1996 | Oshida et al. | 399/114 |
| 6,081,676 | A * | 6/2000 | Inomata | 399/25 |
| 6,553,189 | B2 * | 4/2003 | Miyamoto et al. | 399/27 |
| 6,859,629 | B2 * | 2/2005 | Miura et al. | 399/64 |
| 7,162,174 | B2 * | 1/2007 | Suzuki et al. | 399/64 |
| 2003/0086715 | A1 | 5/2003 | Miura et al. | |

FOREIGN PATENT DOCUMENTS

| | | | | |
|---|---|---|---|---|
| EP | 1477868 | A2 | | 11/2004 |
| JP | 07191540 | A | * | 7/1995 |
| JP | 09-090728 | A | | 4/1997 |
| JP | 2003-043798 | A | | 2/2003 |
| JP | 2003-241501 | A | | 8/2003 |
| JP | 2004-301896 | A | | 10/2004 |
| JP | 2005099458 | A | * | 4/2005 |
| JP | 2005266068 | A | * | 9/2005 |

OTHER PUBLICATIONS

CN Office Action dtd Jul. 4, 2008, CN App 2007100852675.
EP Search Report dtd Jul. 14, 2008, EP Appln. 07003338.6-1240.

* cited by examiner

*Primary Examiner*—Robert Beatty
(74) *Attorney, Agent, or Firm*—Banner & Witcoff, Ltd.

(57) ABSTRACT

A light emitting device and light receiving device are positioned to face each other to sandwich the developer cartridge. A pair of light transmitting tubes is installed in the casing of a developer cartridge. Light emitted from the light emitting device travels inside the casing via the light transmitting tubes and is received by the light receiving device. The direction of light traveling through light transmitting tubes changes along the light path to the light receiving device. When a developer cartridge is attached to the housing, toner blocks light from traveling through the toner chamber to the light receiving device. When the toner is consumed and the developer cartridge is ready to be replaced, light passes through the toner chamber and is received by the light receiving device, prompting exchange of the developer cartridge.

9 Claims, 13 Drawing Sheets

IMAGE FORMING APPARATUS AND DEVELOPER CARTRIDGE HAVING LIGHT TRANSMITTING PORTION TO ALLOW AMOUNT OF DEVELOPER TO BE DETECTED

CROSS REFERENCE TO RELATED APPLICATION

This application claims priority from Japanese Patent Application No. 2006-041250, filed on Feb. 17, 2006, the entire subject matter of which is incorporated herein by reference.

FIELD

Aspects of the present invention relate to an image forming apparatus such as a laser printer, and a developer cartridge installed in the image forming apparatus.

BACKGROUND

In an image forming apparatus such as a laser printer, the toner is generally contained in a developer cartridge. The toner is consumed when image forming is repeated, thereby decreasing the remaining amount of toner in the developer cartridge.

In Japanese Unexamined Patent Application Publication No. 2004-301896, an apparatus is provided for detecting the remaining amount of toner in a developer cartridge. A toner container that is detachable from an image forming apparatus is disclosed. A second light guide is installed on the top of the toner container while a first light guide is installed on the bottom. Light emitted from an LED travels inside the toner container through the first light guide, and then travels through the second light guide to be received by the phototransistor. The remaining amount of toner in the toner container is estimated, based on the result of analysis of the received light. The LED and phototransistor are located on the same board. The light from the LED is deflected by about 90° by the first light guide to travel through the toner container from the bottom to the top. The traveling light is deflected by about 90° by the second light guide. The light traveling through the second light guide is received by the phototransistor.

When the toner container is detached from the image forming apparatus, the light from the LED is not received by the phototransistor, because the light cannot be deflected. On the other hand, if a new toner container is attached to the image forming apparatus, the light from the LED is blocked by the toner from traveling further, so the light does not reach the phototransistor, because the amount of toner in the container is full.

Therefore, in the detector described in Japanese Unexamined Patent Application Publication No. 2004-301896, the state in which the toner container is detached from the image forming apparatus cannot be distinguished from the state in which a new toner container is attached to the image forming apparatus.

SUMMARY

At least some aspects of the invention are directed to easily detecting the amount of developer in a developer cartridge and detecting whether the developer cartridge is attached to the image forming apparatus.

DETAILED DESCRIPTION

1. Overall Configuration of an Illustrative Color Laser Printer

Figure 1:
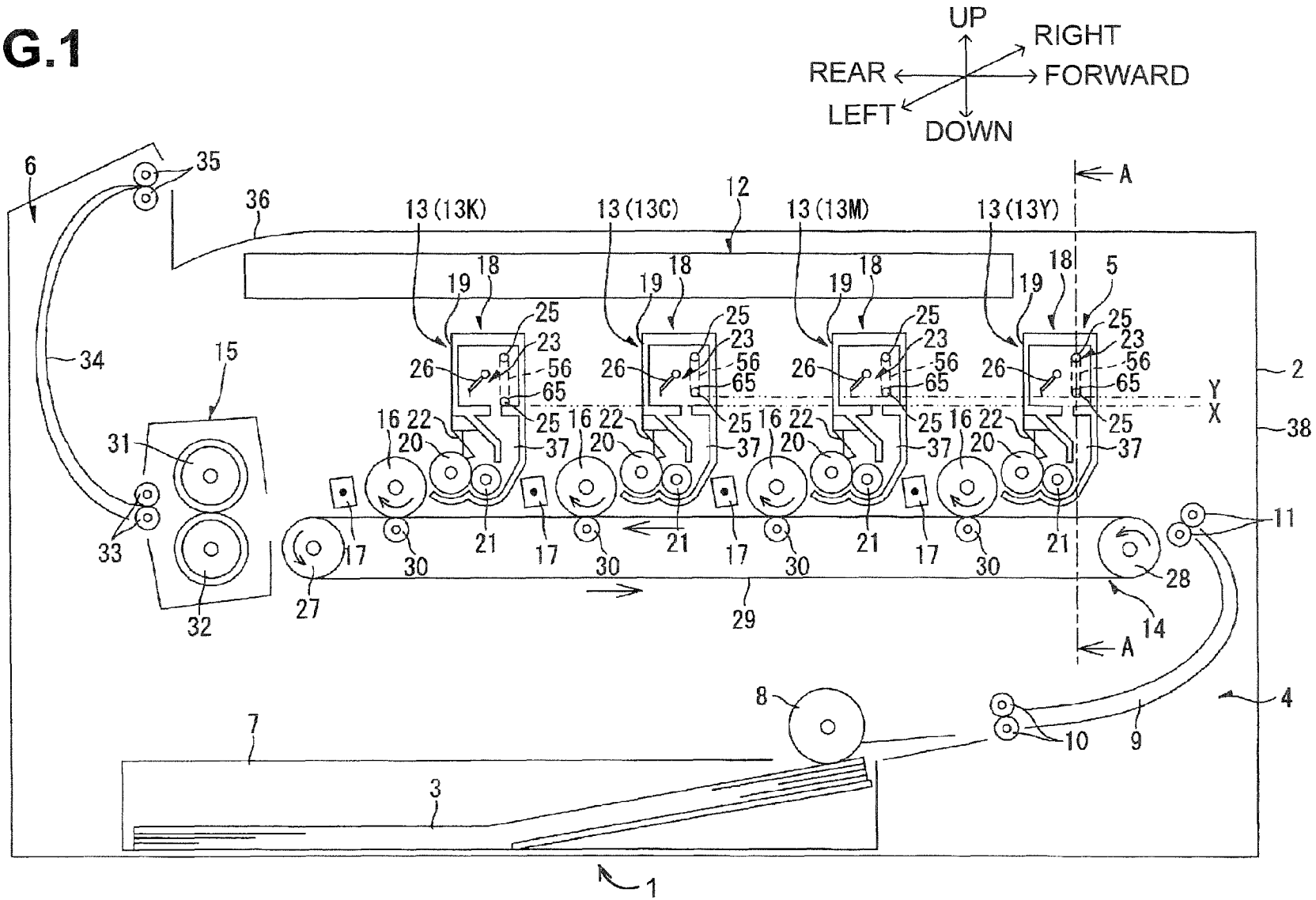
FIG. 1 represents a figure showing one example of a color laser printer according to illustrative aspects of the invention.

In a color laser printer 1, as shown in FIG. 1, multiple parallel process portions 13 (e.g. cartridges) are located horizontally in a box-shaped housing 2. In the housing 2, a paper feeder portion 4 for feeding paper 3, an image forming portion 5 for forming an image on the paper 3, and a paper ejection portion 6 for ejecting the paper 3 are provided.

A front cover 38 is installed on the sidewall of the housing 2 to open or close the housing 2. The front cover 38 can pivot around the lower-edge portion. When the front cover 38 is opened, the process portion 13 becomes detachable from the housing 2.

Note that in the description below, the right side of FIG. 1 (the side where the front cover 38 is installed) is referred to as the "front side," while the left side of FIG. 1 is referred to as the "back side." Furthermore, the near side of the direction vertical to the drawing plane of FIG. 1 is referred to as the "left side," while the far side of the direction vertical to the drawing plane of FIG. 1 is referred to as the "right side."

Figure 4:
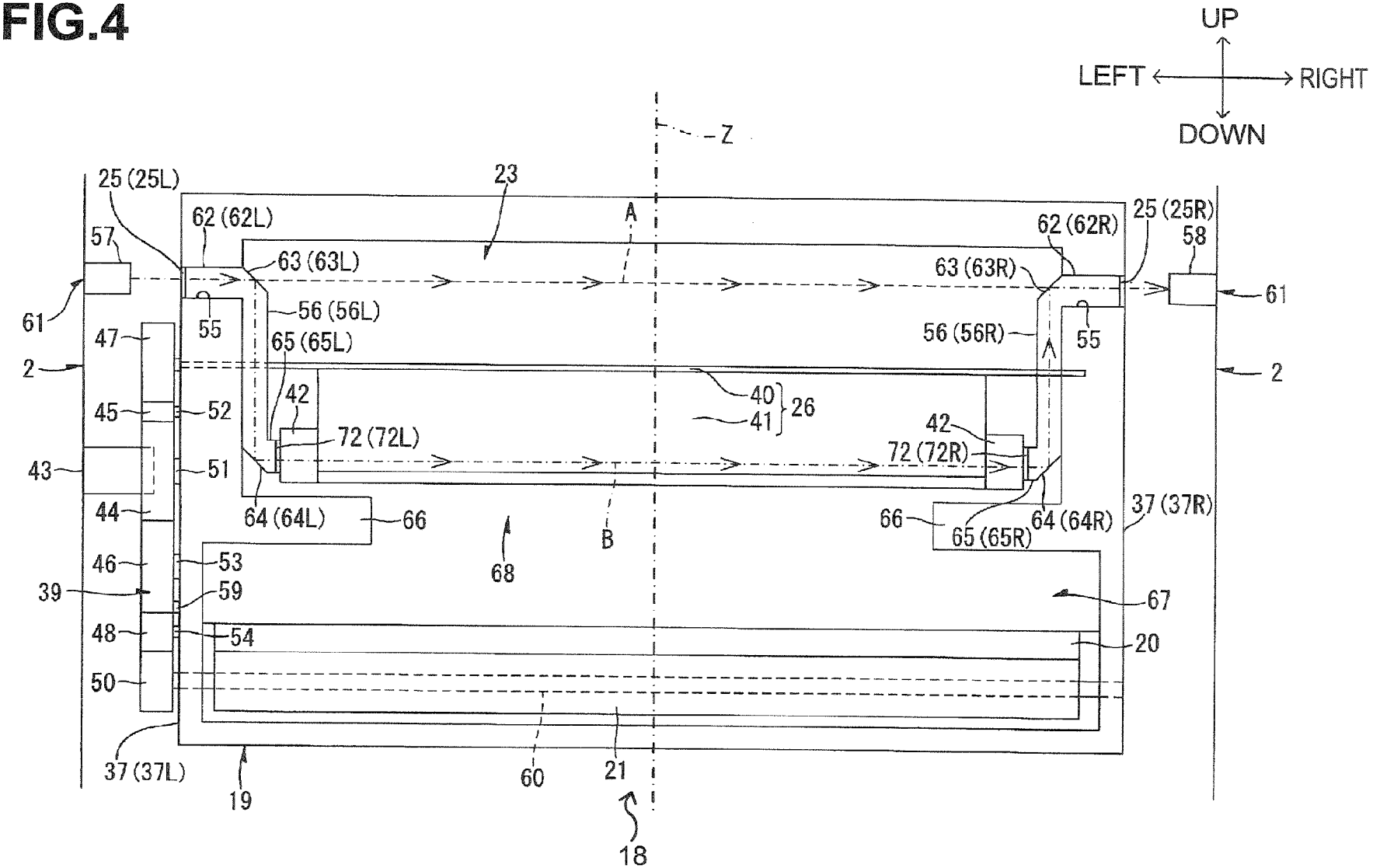
FIG. 4 represents a view of a developer cartridge along the line A-A of the color laser printer shown in FIG. 1.

In the housing 2, as shown in FIG. 4, a light sensor 61 is installed to detect the remaining amount of toner contained in the developer cartridge 18 when the developer cartridge 18 is installed in the process portion 13. The light sensor 61 includes a light emitting device 57 and a light receiving device 58. An LED may be used as the light emitting device 57. A phototransistor may be used as the light receiving device 58. The light emitting device 57 is located on the left side of the developer cartridge 18, while the light receiving device 58 is located on the right side of the developer cartridge 18. When the developer cartridge 18 is not attached to the housing 2, light emitted from the light emitting device 57 travels from left to right along the light path A, shown as a dashed arrow in FIG. 4, and is directly received by the light receiving device 58.

(1) Paper Feeder Portion

As shown in FIG. 1, the paper feeder portion 4 includes a cassette 7, a pickup roller 8, a feed path 9, a pair of feed rollers 10, and a pair of registration rollers 11.

The paper 3 is stacked in the cassette 7 and the top-most sheet of paper 3 is sent out to the feed path 9 as the feed roller 8 rotates.

The paper 3 sent to the feed path 9 is conveyed by the feed rollers 10 and the registration rollers 11.

(2) Image Forming Portion

The image forming portion 5 includes a scanner unit 12, process portion 13, transfer portion 14, and fixation portion 15.

(2-1) Scanner Unit

The scanner unit 12 is located above the multiple process portions 13 at the top inside the housing 2. The scanner unit 12 includes a semiconductor laser, a polygon mirror, an fθ lens, a reflecting mirror, and a lens for optical face angle error correction for each color. A laser beam emitted from the semiconductor laser illuminates the surface of a photoconductive drum 16 via each optical component.

(2-2) Process Portions

Multiple process portions 13 are installed corresponding to the color of the toner. The process portions 13 include four portions: yellow process portion 13Y, magenta process portion 13M, cyan process portion 13C, and black process portion 13K. The process portions 13 are arranged next to each other from front to back, with some space between them. When the front cover 38 is opened, the process portions 13Y, 13M, 13C, and 13K become detachable from front to back.

Each of the process portions 13Y, 13M, 13C and 13K includes a photoconductive drum 16, a charger 17, and a developer cartridge 18.

(2-2-1) Photoconductive Drum and Charger

The photoconductive drum 16 includes a drum body that has a photoconductor on the surface and a drum axis supporting the drum body to enable rotation.

The charger 17 includes a wire and a grid that are arranged facing each other without contacting the photoconductive drum 16. When charged bias is applied to the wire and grid, corona is discharged and the surface of the photoconductive drum 16 is evenly charged.

(2-2-2) Developer Cartridge

The developer cartridge 18 is detachable from the process portion 13. When the developer cartridge 18 is attached to the process portion 13, it becomes detachable from the housing 2.

When the developer cartridge 18 is attached to the process portion 13 and the process portion 13 is attached to the housing 2, the developer cartridge 18 is positioned in front of the photoconductive drum 16. The developer cartridge 18 includes a casing 19, a developer roller 20 disposed inside the casing 19, a supply roller 21, and a film thickness regulating blade 22.

Figure 2:
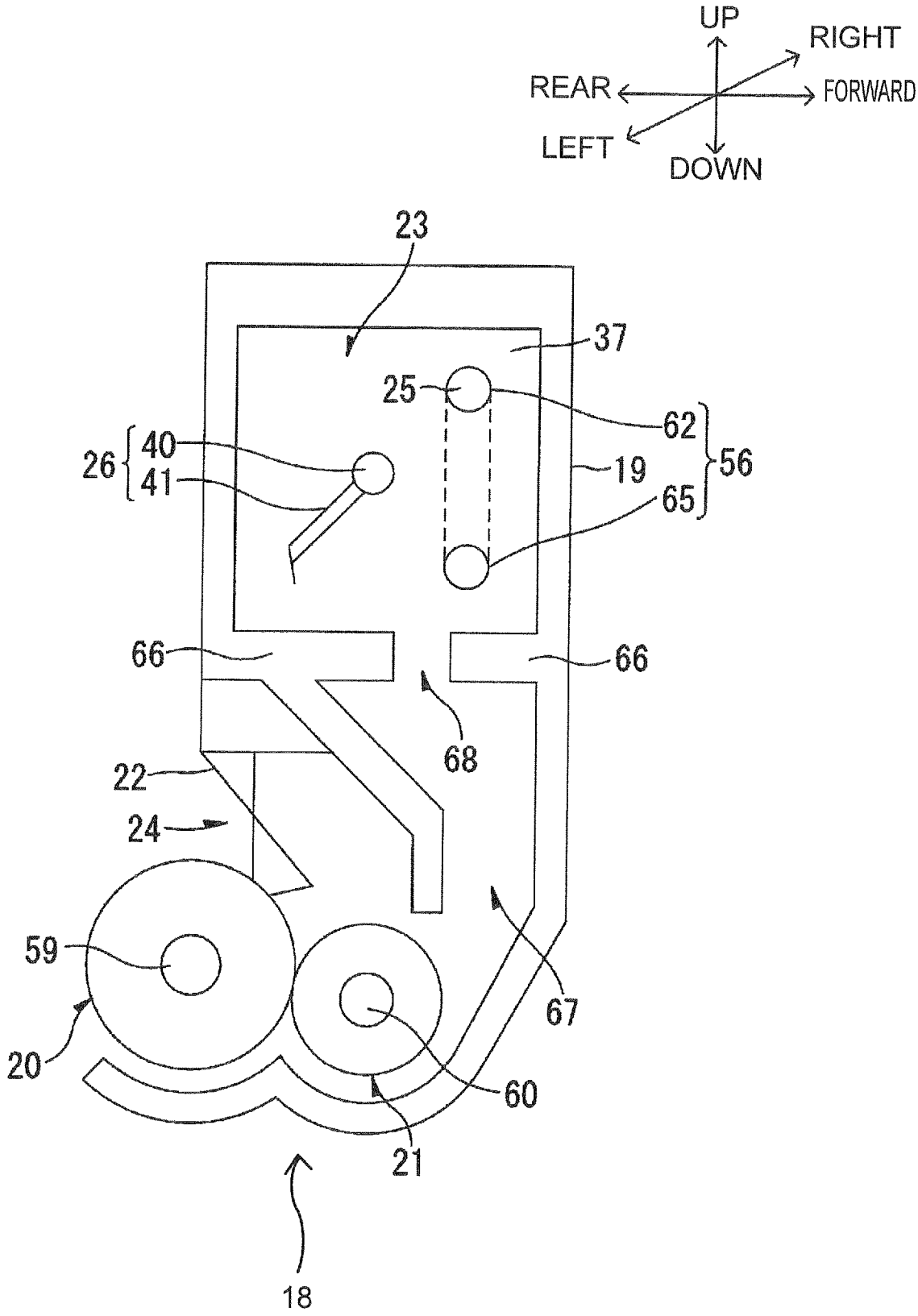
FIG. 2 represents a cross-portion drawing of a developer cartridge according to illustrative aspects of the invention.

The casing 19 is formed in the shape of a box. As shown in FIG. 2, a dividing wall 66 is installed inside the casing 19. The space inside the casing 19 is divided by the dividing wall 66 into a developer chamber 23 and a developing chamber 67. The developer chamber 23 contains developer, which in the examples described herein is toner and will be referred to from hereon as toner chamber 23. The developing chamber 67 contains a developer roller 20, a supply roller 21, and a film thickness regulating blade 22. On the back wall of the casing 19, a rectangular opening portion 24 is formed, which is longer horizontally than vertically. When the developer cartridge 18 is attached to the process portion 13, the opening portion 24 faces the photoconductive drum 16. As shown in FIG. 4, the casing 19 includes a pair of sidewalls 37L and 37R that are facing each other with some space between them. Hereinafter, the left side of the sidewall is referred to as 37L, while the right side of the sidewall is referred to as 37R.

The dividing wall 66 is vertically located in the middle of the casing 19 to vertically divide the cartridge casing 19. The toner chamber 23 is located above the dividing wall 66, while the developing chamber 67 is located below the dividing wall 66. A drain passage 68 is formed in the dividing wall 66. The toner in the toner chamber 23 is sent to the developing chamber 67 through the drain passage 68.

As shown in FIG. 2, an agitator 26 is installed for blending the toner in the toner chamber 23. The agitator 26 includes an axis 40 and a mixer member 41.

Figure 3:
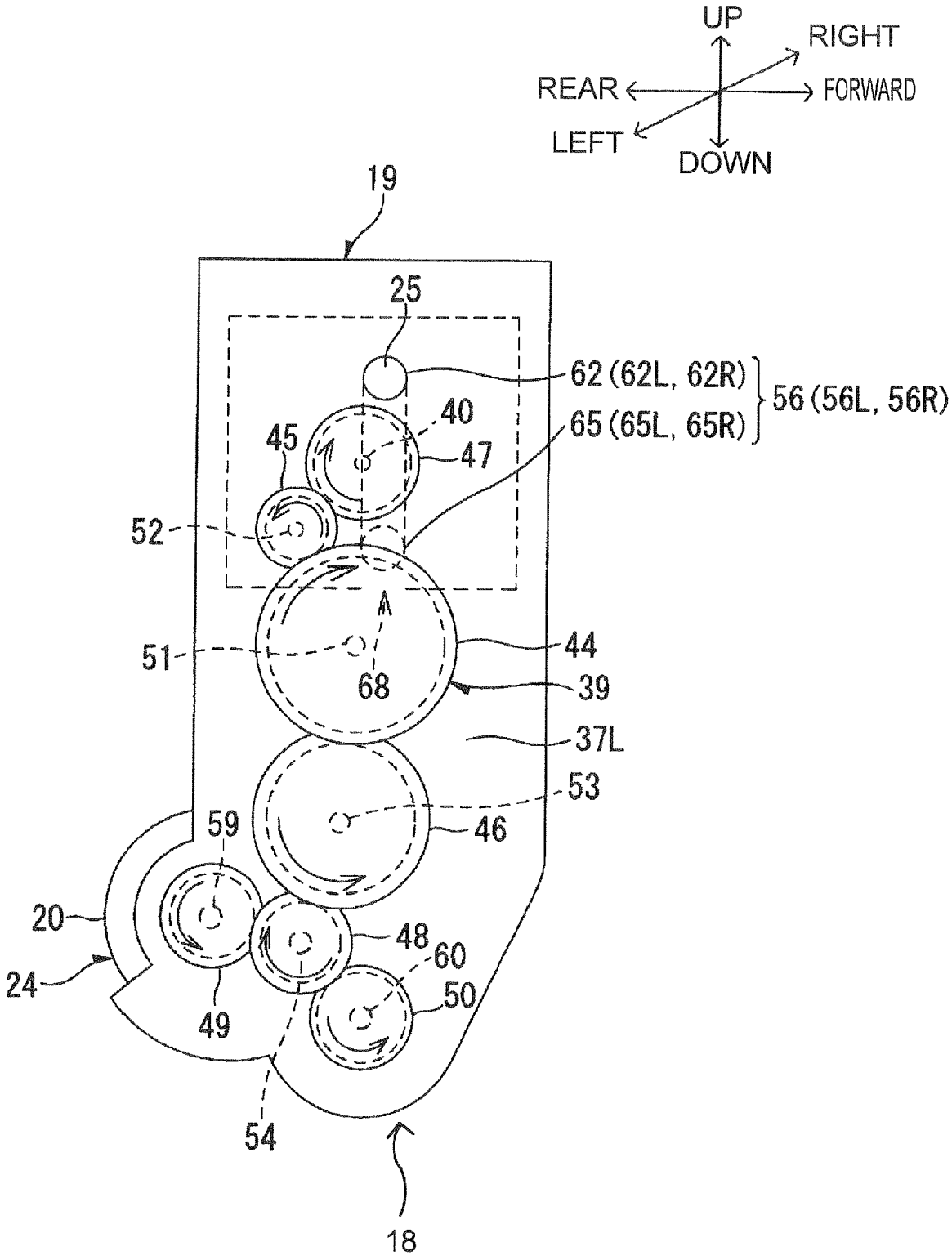
FIG. 3 represents a side view of a developer cartridge.

The axis 40 is supported by the sidewalls 37L and 37R at approximately the center of the toner chamber 23. The mixer member 41 is installed to extend in the direction of the axis 40, i.e. horizontally as shown in FIG. 4. As shown in FIG. 3, an agitator gear 47 is fitted into the left edge portion of the axis 40. Driving force from a motor installed in the housing 2 is input to the axis 40 via the agitator driving gear 47 to rotate the mixer member 41.

As shown in FIG. 4, a wiper 42 is installed on the agitator 26. The wiper 42 is installed on both the left and right edge portions of the mixer member 41. The wiper 42 is made of elastic material such as urethane rubber or polyethylene terephthalate film. As the mixer member 41 rotates, the wiper 42 moves around the axis 40 as if depicting a circle and contacting the sidewalls 37L and 37R.

As shown in FIG. 2, the developer roller 20 is located in the casing 19, with part of the side surface exposed from the opening portion 24. When the developer cartridge 18 is attached to the process portion 13, as shown in FIG. 1, the developer roller 20 is pressed against the photoconductive drum 16. The developer roller 20 includes a developer roller axis 59 made of metal covered by electrically conductive rubber material.

The developer roller axis 59 is supported by the sidewalls 37L and 37R of the casing 19 for free rotation. As shown in FIG. 3, a developer roller gear 49 is fitted onto the left edge portion of the developer roller axis 59. Driving force from a motor installed in the housing 2 can be input to the developer roller axis 59 via the developer roller driving gear 49 to rotate the developer roller 20.

As shown in FIG. 2, the supply roller 21 is pressed against the developer roller 20. The supply roller 21 includes a supply roller axis 60 made of metal covered by electrically conductive sponge material. The supply roller axis 60 is supported by the sidewalls 37L and 37R of the casing 19 for free rotation. As shown in FIG. 3, a supply roller gear 50 is fitted into the left edge portion of the supply roller axis 60. Driving force from a motor installed in the housing 2 is input to the supply roller axis 60 via the supply roller driving gear 50 to rotate the supply roller 21.

In FIG. 4, a gear portion 39 and a gear cover (not shown), which covers the gear portion 39, are installed on the left side of the sidewall 37L.

The gear portion 39 includes an input gear 44 having an axis 51, a first middle gear 45 having an axis 52, a second middle gear 46 having an axis 53, an agitator gear 47 with the axis 40, a middle gear 48 having an axis 54, a developer roller gear 49 having an axis 59, and a supply roller gear 50 with the axis 60, as shown in FIG. 3 and FIG. 4. When the developer cartridge 18 is attached to the housing 2, driving force from the driving gear 43 installed in the housing 2 is applied to the input gear 44. The first middle gear 45 and second middle gear 46 are fitted into the input gear 44. The agitator gear 47 is fitted into the first middle gear 45. The third middle gear 48 is fitted into the second middle gear 46. The developer roller gear 49 and supply roller gear 50 are fitted into the third middle gear 48.

When driving force from the driving gear 43 is input to the input gear 44, the driving force is conveyed to the agitator gear 47 via the first middle gear 45, as shown in FIG. 3. The driving force is also conveyed to the developer roller gear 49 from the input gear 44 via the second middle gear 46 and via the third middle gear 48. Furthermore, the driving force is also conveyed to the supply roller gear 50 from the input gear 44 via the second middle gear 46 and via the third middle gear 48. As described above, the agitator 26, supply roller 21, and developer roller 20 are rotated.

As shown in FIG. 2, the film thickness regulating blade 22 is supported by the housing 19 at a position above the developer roller 20. The edge of the thickness regulating blade 22 is pressed against the developer roller 20.

As shown in FIG. 1, the yellow toner is contained in the toner chamber 23 in the yellow process portion 13Y. Magenta toner is contained in the toner chamber 23 in the magenta process portion 13M. Cyan toner is contained in the toner chamber 23 in the cyan process portion 13C. Black toner is contained in the toner chamber 23 in the black process portion 13K.

(2-2-3) Developing Operation

When an image is formed, the toner contained in the toner chamber 23 is mixed by the agitator 26. The toner reaches the developing chamber 67 through the drain passage 68 due to gravity. In the developing chamber 67, the toner is supplied to the developer roller 20 via the supply roller 21. As the developer roller 20 rotates, the toner supplied on the developer roller 20 passes between the film thickness regulating blade 22 and the developer roller 20 to form a thin film with constant thickness, which is maintained on the surface of the developer roller 20.

After the surface of the photoconductive drum 16 is positively charged evenly by the charger 17, it is exposed to laser light emitted from the scanner unit 12, and an electrostatic latent image is formed.

Next, the toner maintained on the surface of the developer roller 20 is supplied to the electrostatic latent image formed on the surface of the photoconductive drum 16, wherein the electrostatic latent image on the photoconductive drum 16 becomes visible.

(2-3) Transfer Portion

The transfer portion 14 is located above the paper cassette 7 and below the process portion 13 in the housing 2. The transfer portion 14 includes a driving roller 27, a driven roller 28, a transfer belt 29, and transfer rollers 30.

The driving roller 27 is located behind and below the photoconductive drum 16 of the black process portion 13K.

The driven roller 28 is located at the front and below the photoconductive drum 16 of the yellow process portion 13Y.

The transfer belt 29 is an endless belt that is rolled between the driving roller 27 and driven roller 28. The outside surface of the transfer belt 29 contacts each photoconductive drum 16 of each process portion 13.

As the driving roller 27 rotates the transfer belt 29 moves around between the driving roller 27 and driven roller 28.

Each transfer roller 30 is situated inside the locus of the transfer belt 29. The transfer belt 29 is held between each transfer roller 30 and a corresponding photoconductive drum 16. Each transfer roller 30 includes a roller axis made of metal covered by electrically conductive rubber material. The roller axis of each transfer roller 30 extends horizontally and is supported by the housing 2 to enable free rotation.

The paper 3 fed from the paper feeder 4 is transferred from front to back by the transfer belt 29. During the transfer, the yellow toner on the surface of the photoconductive drum 16 of the yellow process portion 13Y is transferred to the paper 3. Then, on the paper 3 on which the yellow toner is already transferred, the magenta toner on the surface of the photoconductive drum 16 of the magenta process portion 13M is transferred on top of the yellow toner. Similarly, the cyan toner and black toner are transferred on top of the yellow toner and magenta toner. As described above, a color image is formed on the paper 3.

(2-4) Fixation Portion

The fixation portion 15 is located at the back of the transfer portion 14. The fixation portion 15 includes a heating roller 31, a pressure roller 32, and a transfer roller 33. The heating roller 31 includes a metal tube with an exfoliating film on its surface. A halogen lamp is situated inside the metal tube. When the halogen lamp is turned on, the surface of the heating roller 31 is heated. The pressure roller 32 is located below the heating roller 31 and pushes the bottom of the heating roller 31. The transfer roller 33 includes a pair of rollers and is located behind the heating roller 31 and pressure roller 32.

The paper 3 is heated and pressed when it passes through the heating roller 31 and pressure roller 32, and the color image on the paper 3 is fixed on the paper 3. The paper 3 with the fixed color image is sent to the paper ejection portion 6 by the transfer roller 33.

(3) Paper Ejection Portion

The paper ejection portion 6 includes a paper ejection path 34, paper ejection rollers 35, and a paper catch tray 36.

The paper ejection rollers 35 are installed as a pair of rollers at the downstream edge of the paper ejection path 34.

The paper catch tray 36 is a wall forming the top surface of the housing 2. The top surface of the paper catch tray 36 is slanted downward from front to back.

The paper 3 sent from the transfer roller 33 is ejected toward the front by the paper ejection roller 35 via the paper ejection path 34. The ejected paper 3 is stacked on the paper catch tray 36.

2. Detecting Remaining Amount of Toner

As shown in FIG. 4, a through-hole 55 is formed through the sidewalls 37L and 37R at a position above the gear portion 39.

The edge portion 62 of the light transmitting tube 56 is inserted into the through-hole 55. The light transmitting tube 56 is formed as a hollow circular cylinder in a simple Z shape. The left light transmitting tube 56L is located inside the left sidewall 37L. The right light transmitting tube 56R is located inside the right sidewall 37R. The face of the inner circumference of the light transmitting tubes 56L and 56R is a mirror surface that fully reflects the light. The light transmitting tubes 56L and 56R are common parts. Light transmitting tube 56L and light transmitting tube 56R are situated in positions symmetrical to the baseline Z in FIG. 4, vertically parallel to enable light to pass through the center of the toner chamber 23.

On the light transmitting tube 56, a first deflecting portion 63, a second deflecting portion 64, and another edge portion 65 as well as the edge portion 62 described above are formed integrally.

An outer window 25L is inserted at the left edge portion of the edge portion 62L of the left light transmitting tube 56L. The outer window 25L is a transparent circular plate. The peripheral surface of the outer window 25L is in close contact with the inner surface of the edge portion 62L. The edge portion 62L is located above the axis 40 of the agitator 26.

The light transmitting tube 56L extends right from the edge portion 62L and bends downward at the inner surface of the sidewall 37L. The bended point serves as the first deflecting portion 63L. On the first deflecting portion 63L, a reflecting surface that is formed slants to the right and downward by 45° from a line parallel to the light path A. The light transmitting tube 56L extends downward along the inner surface of the sidewall 37L from the first deflecting portion 63L and bends right at the second deflecting portion 64L. When the position of the second deflecting portion 64L is projected horizontally in FIG. 4, it overlaps the position of gear portion 39. The position of the second deflecting portion 64L is situated slightly higher than the dividing wall 66 and drain passage 68.

On the second deflecting portion 64L, a reflecting surface slants to the right and downward by 45° from a line parallel to the light path B.

The light transmitting tube 56L extends from the second deflecting portion 64L to the right side through the edge portion 65L of the light transmitting tube 56L. Therefore, the distance from the edge portion 62L to the drain passage 68 is larger than the distance from the edge portion 65L to the drain passage 68. An inner window 72L is inserted in the right edge portion of the edge portion 65L. The inner window 72L is a transparent circular plate. The peripheral surface of the inner window 72L is in close contact with the inner surface of the edge portion 65L.

The edge portion 65L is located below the axis 40 of the agitator 26. The edge portion 65L is located at a position to match the movement locus of the wiper 42 as the axis 40 rotates. Therefore, when the wiper 42 moves, it contacts the inner window 72L so that the wiper 42 cleans the inner window 72L.

An outer window 25R is inserted in the right edge portion of the edge portion 62R of the right light transmitting tube 56R. The outer window 25R is a transparent circular plate. The peripheral surface of the outer window 25R is in close contact with the inner surface of the edge portion 62R. The edge portion 62R is located above the axis 40 of the agitator 2.

The light transmitting tube 56R extends left from the edge portion 62R and bends downward at the inner surface of the sidewall 37R. The bended point serves as the first deflecting portion 63R. On the first deflecting portion 63R, a reflecting surface slants to the left and downward by 45° from a line parallel to the light path A.

The light transmitting tube 56R extends downward along the inner surface of the sidewall 37R from the first deflecting portion 63R and bends to the left at the second deflecting portion 64R. When the position of the second deflecting portion 64R is projected horizontally in FIG. 4, it overlaps the position of gear portion 39. The position of the second deflecting portion 64R is located slightly higher than the dividing wall 66 and drain passage 68. On the second deflecting portion 64R, a reflecting surface slants to the left and downward by 45° from a line parallel to the light path B.

The light transmitting tube 56R extends from the second deflecting portion 64R to the left side through the edge portion 65R of the light transmitting tube 56R. Therefore, the distance from the edge portion 62R to the drain passage 68 is larger than the distance from the edge portion 65R to the drain passage 68.

An inner window 72R is inserted in the left edge portion of the edge portion 65R. The inner window 72R is a transparent circular plate. The peripheral surface of the inner window 72R is in close contact with the inner surface of the edge portion 65R.

The edge portion 65R is located below the axis 40 of the agitator 26. The edge portion 65R is located at a position to match the movement locus of the wiper 42 as the axis 40 rotates. Therefore, when the wiper 42 moves, it contacts the inner window 72R so that the wiper 42 cleans the inner window 72R.

The edge portion 65R of the right light transmitting tube 56R and the edge portion 65L of the left light transmitting tube 56L are positioned to face each other. The edge portion 62R of the right light transmitting tube 56R and the edge portion 62L of the left light transmitting tube 56L are positioned to face each other. The line connecting the edge portion 65R and the edge portion 65L is parallel to the line connecting the edge portion 62R and edge portion 62L.

When the developer cartridge 18 is attached to the housing 2, the light emitting device 57 faces the outer window 25L, whereas the light receiving device 58 faces the outer window 25R.

Light emitted from the light emitting device 57 enters the light transmitting tube 56L through the outer window 25L.

Inside the light transmitting tube 56L, the light travels to the right from the edge portion 62L toward the first deflecting portion 63L, and at the first deflecting portion 63L, the light is deflected by 90° to travel downward. At the second deflecting portion 64L the light is deflected by 90° to travel to the right. The light is emitted from the inner window 72L to the toner chamber 23 and travels to the right inside the toner chamber 23. The light enters the light transmitting tube 56R through the inner window 72R.

The light entering from the inner window 72R into the light transmitting tube 56R travels right to the second deflecting portion 64R, and at the second deflecting portion 64R the light is deflected by 90° upward. The light is further deflected by 90° at the first deflecting portion 63R to travel to the right and radiates through the outer window 25R, and then the light is received by the light receiving device 58.

When the developer cartridge 18 is attached to the housing 2, light emitted from the light emitting device 57 travels along the light path B indicated by the dotted line in FIG. 4 and reaches the light receiving device 58.

The CPU detects the remaining amount of toner in the toner chamber 23 according to the light detection status at the light receiving device 58. When the remaining amount of toner in the toner chamber 23 exceeds "the remaining amount immediately before the toner is empty," the light receiving device 58 does not detect the light, because the light emitted from the inner window 72L to the toner chamber 23 is blocked by the toner.

On the other hand, when the remaining amount of toner in the toner chamber 23 becomes less than "the remaining amount immediately before the toner is empty," the light is not blocked by the toner. At this time, the light receiving device 58 detects the light. The CPU displays a "Toner Empty" warning on the operation panel, based on the detected results in order to prompt the user to replace the developer cartridge 18.

"The remaining amount immediately before the toner is empty" is the amount of toner left in the toner chamber 23 up to the upper limit of the edge portions 65L and 65R of the light transmitting tubes 56L and 56R.

As described above, the edge portions 65L and 65R of the light transmitting tubes 56L and 56R are located just above the dividing wall 66 and the drain passage 68. The toner passes through the drain passage 68 by gravity. When the amount of toner left is up to the upper limit of the edge portions 65L and 65R, the toner is almost empty in the toner chamber 23 and most of the toner remaining in the developer cartridge 18 is in the developing chamber 67.

When the toner is filled above the top of the edge portions 65L and 65R, the inner window 72L is covered by the toner so that the light is blocked by the toner and does not travel through the toner chamber 23. Because the light is not received by the receiving device 58, the CPU determines that it is not time to replace the developer cartridge 18.

On the other hand, if the top of the toner in the toner chamber 23 is below the edge portions 65L and 65R, the light emitted into the toner chamber 23 through the inner window 72L is not blocked by the toner. The light travels through the toner chamber 23 and is received by the light receiving device 58 through the light transmitting tube 56R. The CPU determines that the amount of toner in the toner chamber 23 has become less than the defined amount and displays a warning on the operation panel that the toner is empty in order to prompt the user to replace the developer cartridge 18.

3. Effects of Action

As described above, when the developer cartridge 18 is not attached to the housing 2, light emitted from the light emitting device 57 travels from left to right along the light path A and is directly received by the light receiving device 58 as shown in the FIG. 4. When the developer cartridge 18 is attached to the housing 2, the light path A is blocked by the developer cartridge 18 so that the light is not received by the light receiving device 58. Therefore, the CPU can detect that the developer cartridge 18 is attached to the housing 2 based on detection results of the light receiving device 58.

When the developer cartridge 18 is attached to the housing 2, if the remaining amount of the toner is higher than the edge portions 65L and 65R of the light transmitting tubes 56L and 56R, the light that should travel along the light path B is blocked by the toner and is unable to travel through the toner chamber 23. This makes it impossible for the light to be received by the light receiving device 58. Therefore, it is possible to detect that the remaining amount of toner in the toner chamber 23 is sufficient.

According to this aspect, it can be easily detected that "the developer cartridge 18 is attached to the housing 2" and "the remaining amount of toner in the developer cartridge 18 is sufficient."

On the other hand, when the toner in the toner chamber 23 is consumed and the top of the toner is located below the edge portions 65L and 65R of the light transmitting tubes 56L and 56R, the light emitted into the toner chamber 23 through the light transmitting tube 56L is not blocked by the toner from traveling further, and it travels along the light path B through the toner chamber 23 before being received by the light receiving device 58 through the light transmitting tube 56R. Therefore, it is possible to detect that the remaining amount of toner in the toner chamber 23 has decreased to the state at which "replacement of the developer cartridge 18" is necessary. Note that the light path A and the light path B are parallel to each other.

The light transmitting tubes 56L and 56R are configured to deflect light, so light can enter the toner chamber 23 or be emitted from the toner chamber 23 at any point on the sidewalls 37L and 37R.

The edge portion 62L of the light transmitting tube 56L is located above the gear portion 39, so the light emitted from the light emitting device 57 can freely enter the edge portion 62L without being blocked by the gear portion 39.

The light transmitting tubes 56L and 56R are configured to deflect light, so the edge portions 65L and 65R can be located at the most suitable position to detect the remaining amount of toner. In addition, the gear portion 39 can be located in a position so as to efficiently apply drive force to each gear.

Consequently, the functions of the color laser printer 1 and the developer cartridge 18 can be improved. At the same time, the degree of freedom in design of the developer cartridge 18 can be increased.

The edge portions 62L and 62R can be situated so as to be symmetric with respect to a parallel plane, passing through the baseline Z, while the edge portions 65L and 65R are situated so as to be symmetrical with the parallel plane, passing through the baseline Z. This positioning can be realized simply by changing the direction where the common parts, light transmitting tube 56L, and the light transmitting tube 56R are positioned. Thus, a developer cartridge 18 can be easily produced.

The light emitting device 57 and light receiving device 58 are positioned on opposite end of a horizontal line through the casing 19, so the color laser printer 1 may be simply configured.

The light transmitting tube 56L and 56R are configured to change the traveling direction of light, so the amount of toner in the toner chamber 23 can be easily and accurately detected according to the type of developer cartridge 18. This is explained in detail below.

(1) Toner Filling Amount

Figure 13:
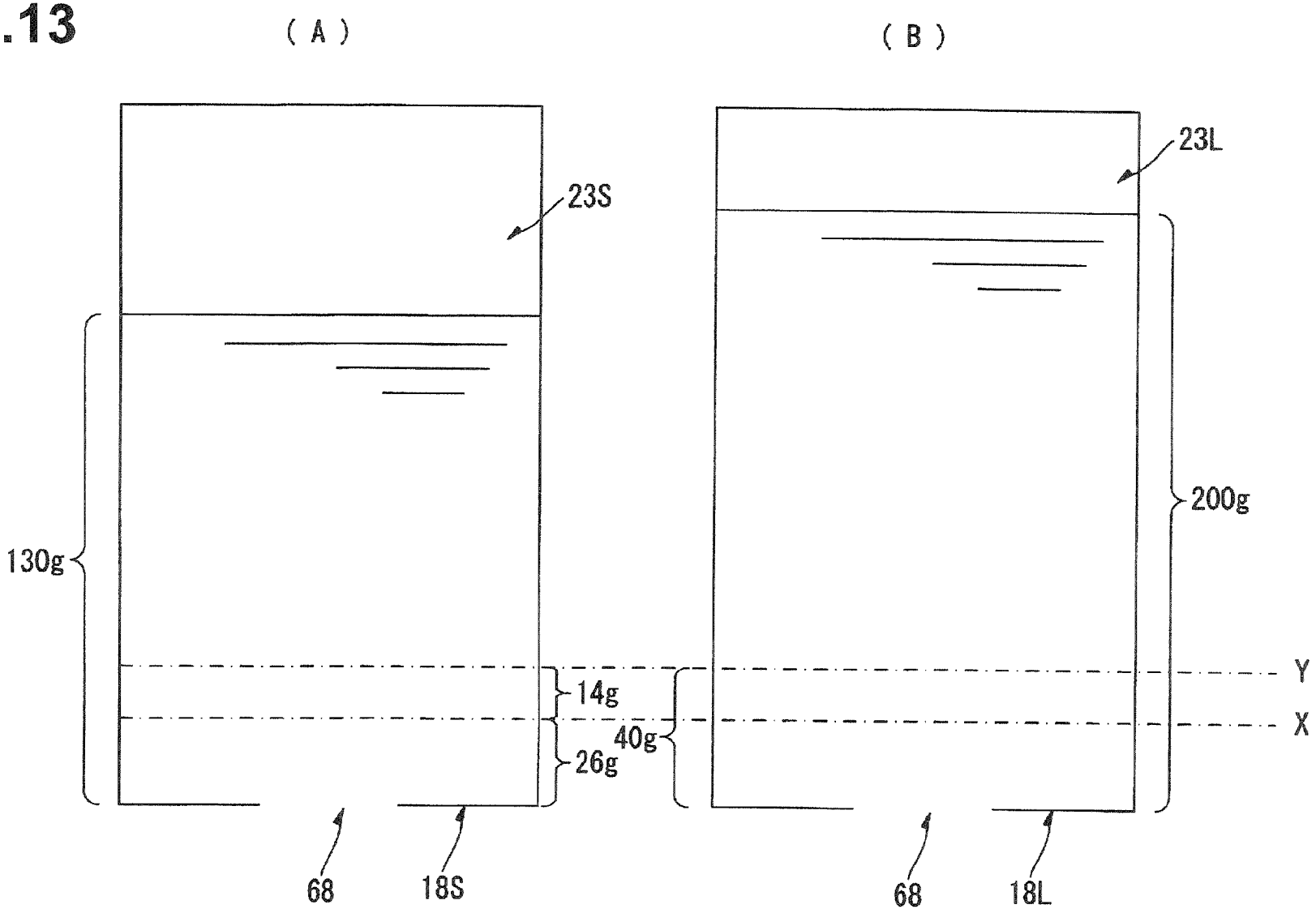
FIGS. 13A and 13B represent a view of the amount of toner filled in a standard type of developer cartridge and a view of the amount of toner filled in a long-life type of developer cartridge, respectively.

Two types of the developer cartridge 18—standard and long-life—are available for the same color according to usage by users. FIG. 13A represents a view of the amount of toner filled in a standard type developer cartridge 18S, whereas FIG. 13B represents a view of the amount of toner filled in a long-life type developer cartridge 18L.

In a standard type of developer cartridge 18S, the toner is filled sufficiently to print 4,000 pages when printed at a 5% printing ratio on an A4-size sheet of paper. In a long-life type of developer cartridge 18L, the toner is sufficiently filled to print 6,000 pages when printed at a 5% printing ratio on an A4-size sheet of paper.

As shown in FIG. 13A, 130 grams of toner is filled in a toner chamber 23S in the standard type of developer cartridge 18S. 104 grams of toner is used to print 4,000 pages, and the remaining 26 grams is not available for use after 4,000 pages are printed. This 26 grams of toner accounts for toner deterioration due to mechanical fatigue, which is continuously incurred by being mixed with an agitator, heat fatigue incurred when toner is not supplied to a photoconductive drum is returned to the toner chamber 23S, or aging.

Charging of deteriorated toner is more difficult than charging fresh toner, as the deteriorated toner often adheres to an area other than electrostatic latent images on the photoconductive drum, resulting in poor images.

To prevent poor images, it is necessary for light to pass through the toner chamber 23S at position X representing the threshold amount of 26 grams of toner contained in the toner chamber 23S.

When more than the threshold amount, 26 grams, of toner is left, at position X, light is blocked by the toner and not received by the light receiving device such that continued use of the toner is appropriate. When the remaining amount of toner is equal to or less than the threshold amount, 26 grams, the light passes through the toner chamber 23S and is received by the light receiving device 58 so that a warning may be generated, e.g. displayed, to indicate that it is time to replace the toner.

As shown in FIG. 13B, 200 grams of toner is filled in a toner chamber 23L in the long-life type developer cartridge 18L. The number of pages to be printed is greater than the standard type, so deteriorating factors have a potentially greater impact on the toner, and the threshold amount of toner for the long-life developer cartridge 18L is 40 grams, which is greater than the threshold amount of 26 grams for the standard type developer cartridge 18S. Therefore, when the remaining amount of toner in the toner chamber 23L is 40 grams, light must be able to pass through the toner chamber 23L at position Y, which is higher than position X where the light is able to pass through the toner chamber 23S with the standard type developer cartridge 18S.

When the light transmitting tube described above is not employed, the position through which the light travels is horizontally different according to the amount of toner filled in the toner chamber 23. Therefore, the position of the light emitting device and the light receiving device installed in the housing and the position of the through-hole installed on the developer cartridge must be adjusted to a position where the light passes through according to the type of toner chamber 23 and its corresponding threshold amount. However, it is not very practical to require the user to change the positions of the light emitting device, light receiving device, and through-hole according to the type of developer cartridge which has been installed. Effectively, it may be necessary to use two types of printer one to accommodate a standard type developer cartridge and a second to accommodate a long-life developer cartridge.

For configurations without a light transmitting tube, it can be necessary to arrange the light emitting device, light receiving device, and through-hole at the same height as position X or position Y. However, the height of position X and position Y would be closer to the height of the gear portion so that the degree of freedom for arranging the light emitting device and light receiving device is further limited.

On the other hand, the standard type of developer cartridge 18S could be configured for light to pass through the toner chamber 23S at position Y, when the remaining amount of toner becomes 40 grams. However, for the standard type developer cartridge 18S to print 4,000 pages 104 grams of toner would be needed as described above, but 144 grams of the toner must have been filled originally in the developer cartridge to achieve the 4,000 page level of performance because it will be determined that the toner needs to be replaced when the remaining amount is 40 grams as opposed to 26 grams. As such, 14 grams of toner would effectively be unnecessarily wasted if a standard type developer cartridge were used with 144 grams toner capacity.

(2) Toner Type

As described above, a colored toner—cyan, magenta, yellow, black—is filled in each toner chamber 23 in the developer cartridge 18. Each toner contains different components for each color, so each has different deterioration characteristics. For example, if the yellow toner deteriorates earlier than the black toner, when 4,000 pages are printed for the standard type of developer cartridge 18S, the remaining amount of toner unavailable for use is 26 grams for black but 50 grams for yellow.

Therefore, the horizontal positions of the light emitting device, light receiving device, and through-hole should be changed according to the color of the toner. In addition, when the horizontal positions of the light emitting device, light receiving device, and through-hole are common for a yellow cartridge and a black cartridge, to exchange the yellow cartridge and black cartridge at the same time after 4,000 pages are printed out, 154 grams of toner must be filled for both the yellow toner chamber 23 and black toner chamber 23, which would result in 24 grams of yellow toner being wasted.

(3) Effects of Action for the Light Transmitting Tube

In the illustrative color laser printer 1, the edge portions 65L and 65R of the light transmitting tubes 56L and 56R are positioned just above the threshold amount of remaining toner that indicates that it is time to replace the developer cartridge 18, while the edge portions 62L and 62R of the light transmitting tubes 56L and 56R are positioned above the gear portion 39.

By bending the light path using the light transmitting tube 56L and 56R, the light emitting device 57, light receiving device 58, and through-hole 55 can be set at common positions away from the gear portion 39, regardless of the differences in the characteristics of the developer cartridge 18 such as toner filling amount and differences in toner type such as toner colors.

Edge potions 62L and 62R and edge portions 65L and 65R can be set at the most suitable position by selecting the length between the first deflecting part 63L and the second deflecting part 64L of the light transmitting tube 56L, and the length between the first deflecting portion 63R and the second deflecting portion 64R of the light transmitting tube 56R.

4. EXAMPLES

(1) Example 1

Figure 5:
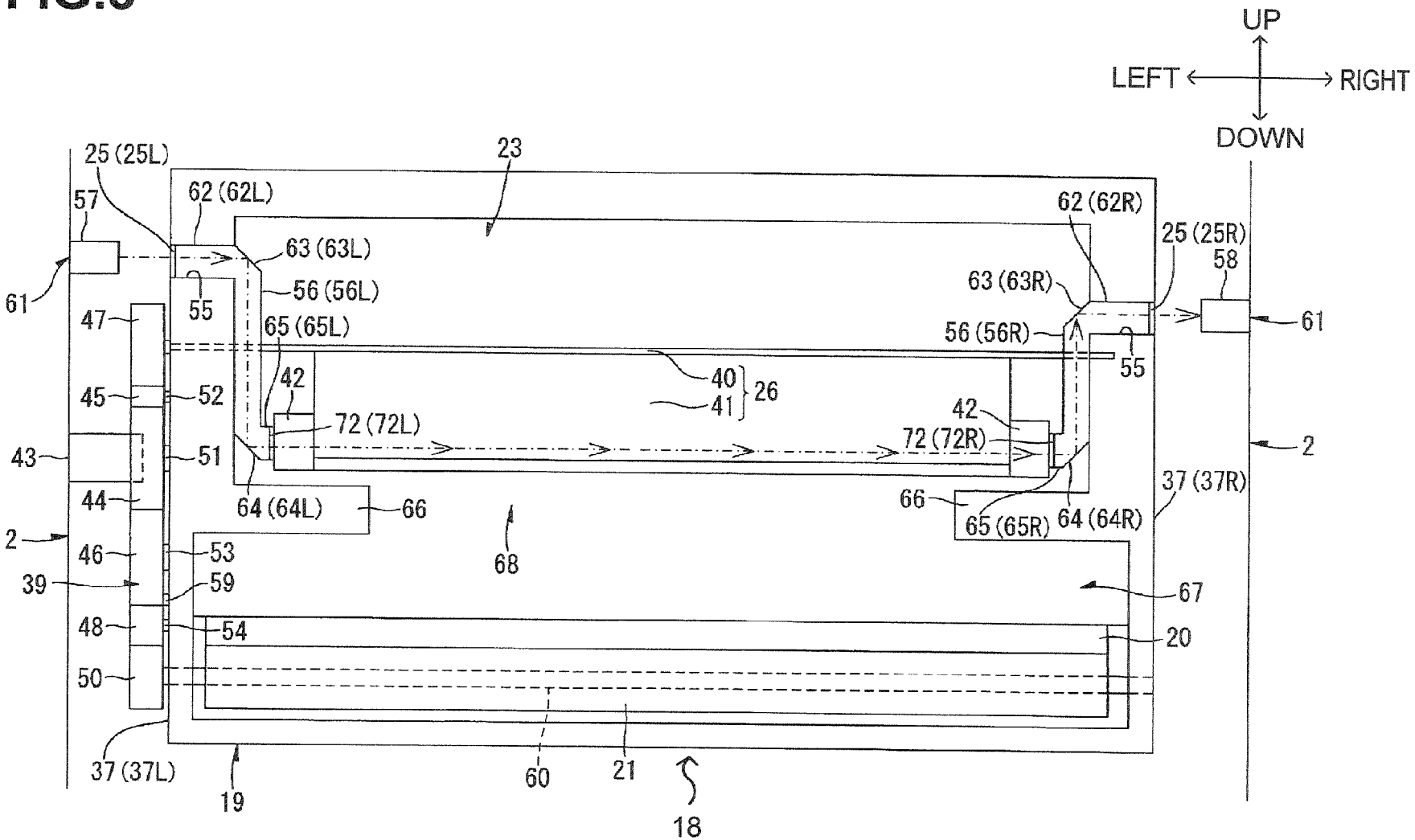
FIG. 5 represents a first aspect in which a modification is made to the developer cartridge in FIG. 4.

FIG. 5 represents a first aspect, example 1, in which a modification is made to the developer cartridge 18 in FIG. 4. Note that in FIG. 5, the same symbols refer to the same parts described above, so the description thereof has been omitted.

As shown in example 1 in FIG. 5, the edge portion 62R of the right light transmitting tube 56R, the light receiving device 58, and the right toner detection outer window 25R may be set lower than the edge portion 62L of the left light transmitting tube 56L, light emitting device 57, and left toner detection outer window 25L. Conversely, the edge portion 62L of the left light transmitting tube 56L, light emitting device 57, and left toner detection outer window 25L may be set lower than the edge portion 62R of the right light transmitting tube 56R, light receiving device 58, and right toner detection outer window 25R.

Thus, another component can be placed at the previous position from which the light emitting device 57 or light receiving device 58 was moved. However, the light emitting device 57 and light receiving device 58 are not located on a line in the left/right direction of FIG. 5 when the developer cartridge 18 is detached from the housing 2. If the position of the light emitting device 57 and the light receiving device 58 is adjusted so that the detected light emitted from the light emitting device 57 is directly received by the light receiving device 58, it is possible to detect the toner amount or whether the developer cartridge 18 is attached to the housing 2.

(2) Example 2

Figure 6:
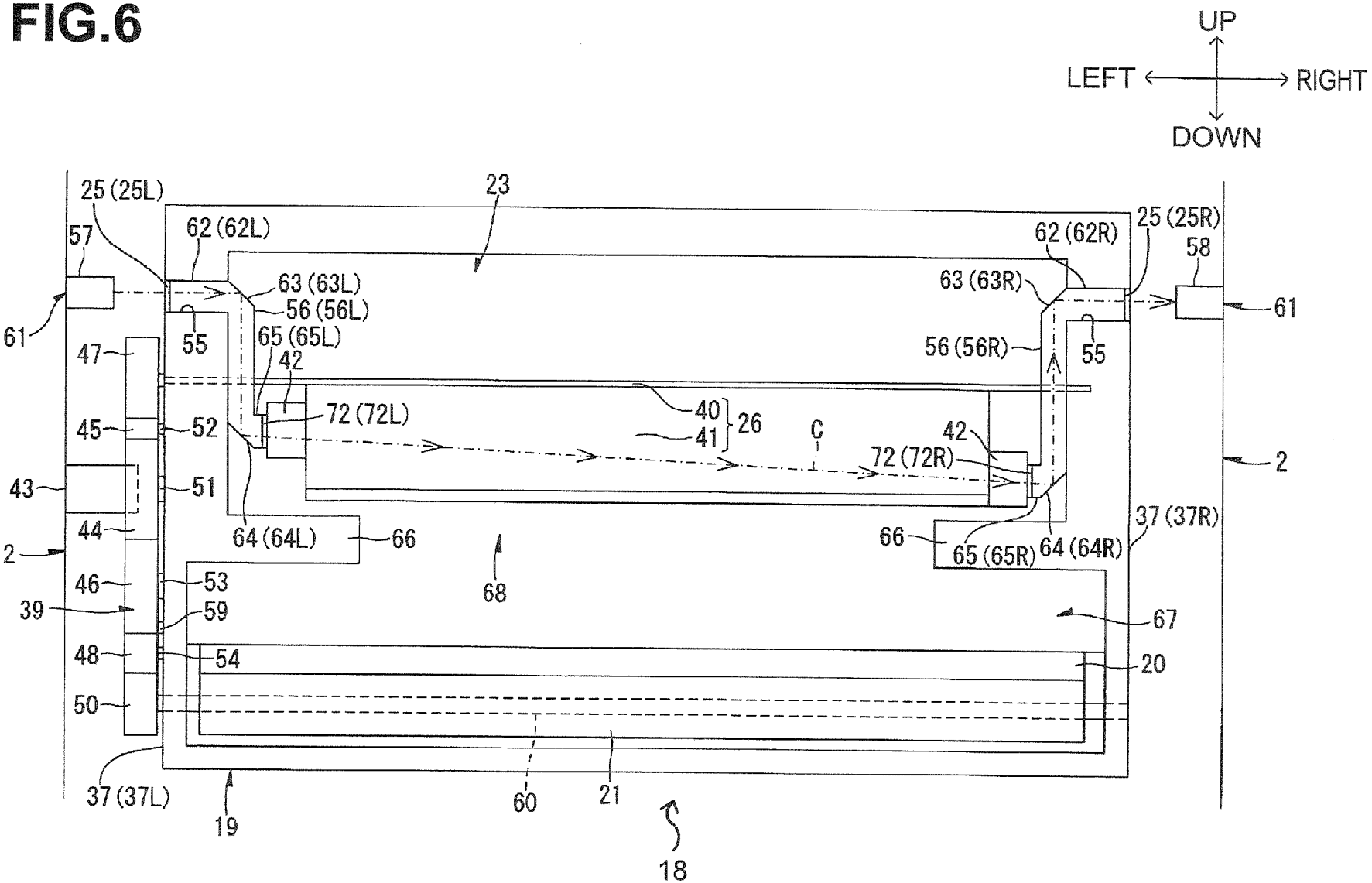
FIG. 6 represents a second aspect in which a modification is made to the developer cartridge in FIG. 4.
Figure 7:
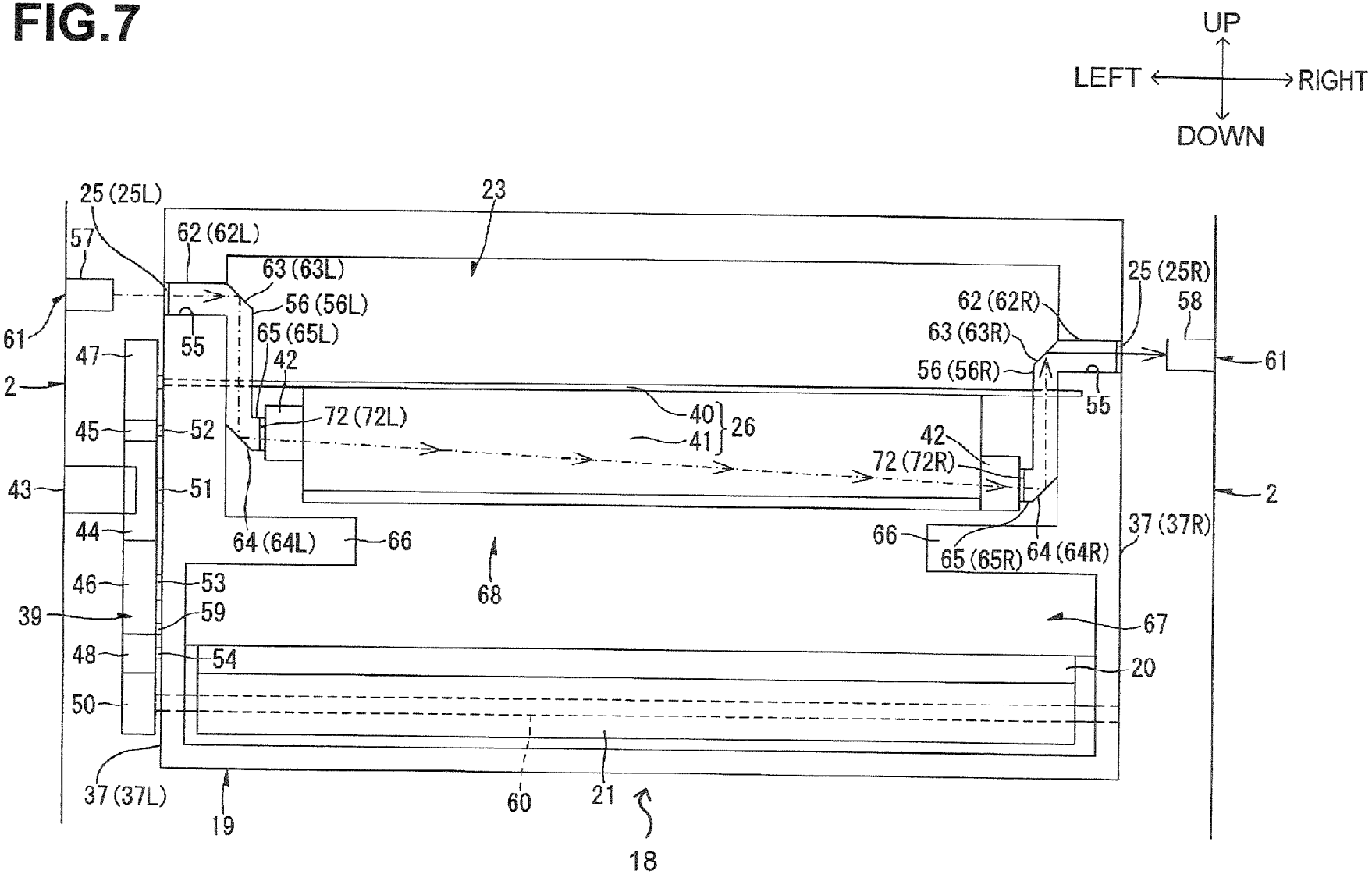
FIG. 7 represents another aspect in which a modification is made to the developer cartridge in FIG. 4.

FIG. 6 represents a second aspect, example 2, in which a modification is made to the developer cartridge 18 in FIG. 4. Furthermore, FIG. 7 represents another aspect in which the modifications in examples 1 and 2 are applied to the developer cartridge in FIG. 4. Note that the same symbols refer to the same parts described above, and the description thereof has been omitted in FIGS. 6 and 7.

As shown in FIG. 6, as example 2, the edge portion 65L of the left light transmitting tube 56L may be set above the edge portion 65R of the right light transmitting tube 56R. Conversely, the edge portion 65R of the right light transmitting tube 56R may be set above the other edge portion 65L of the left light transmitting tube 56L.

In this case, to accurately detect the amount of toner in the toner chamber 23, the edge portion 65L and the edge portion 65R should be set so that the bottom of the light path C (refer to the dotted arrow in FIG. 6) detecting light from the left edge portion 65L to the right edge portion 65R is positioned just above the threshold amount of toner at which it is time to replace the developer cartridge 18.

Alternatively, as shown in FIG. 7, by combining examples 1 and 2, the edge portion 62R of the right light transmitting tube 56R, light receiving device 58, and right outer window 25R may be set below the edge portion 65L of the left light transmitting tube 56L, light emitting device 57, and left outer window 25L, and the edge portion 65L of the left light transmitting tube 56L may be set above the edge portion 65R of the right light transmitting tube 56R. Conversely, the edge portion 62L of the left light transmitting tube 56L, light emitting device 57, and left outer window 25L may be set below the edge portion 62R of the left light transmitting tube 56R, light receiving device 58, and right outer window 25R, and the edge portion 65R of the right light transmitting tube 56R may be set above the edge portion 65L of the left light transmitting tube 56L.

(3) Example 3

Figure 8:
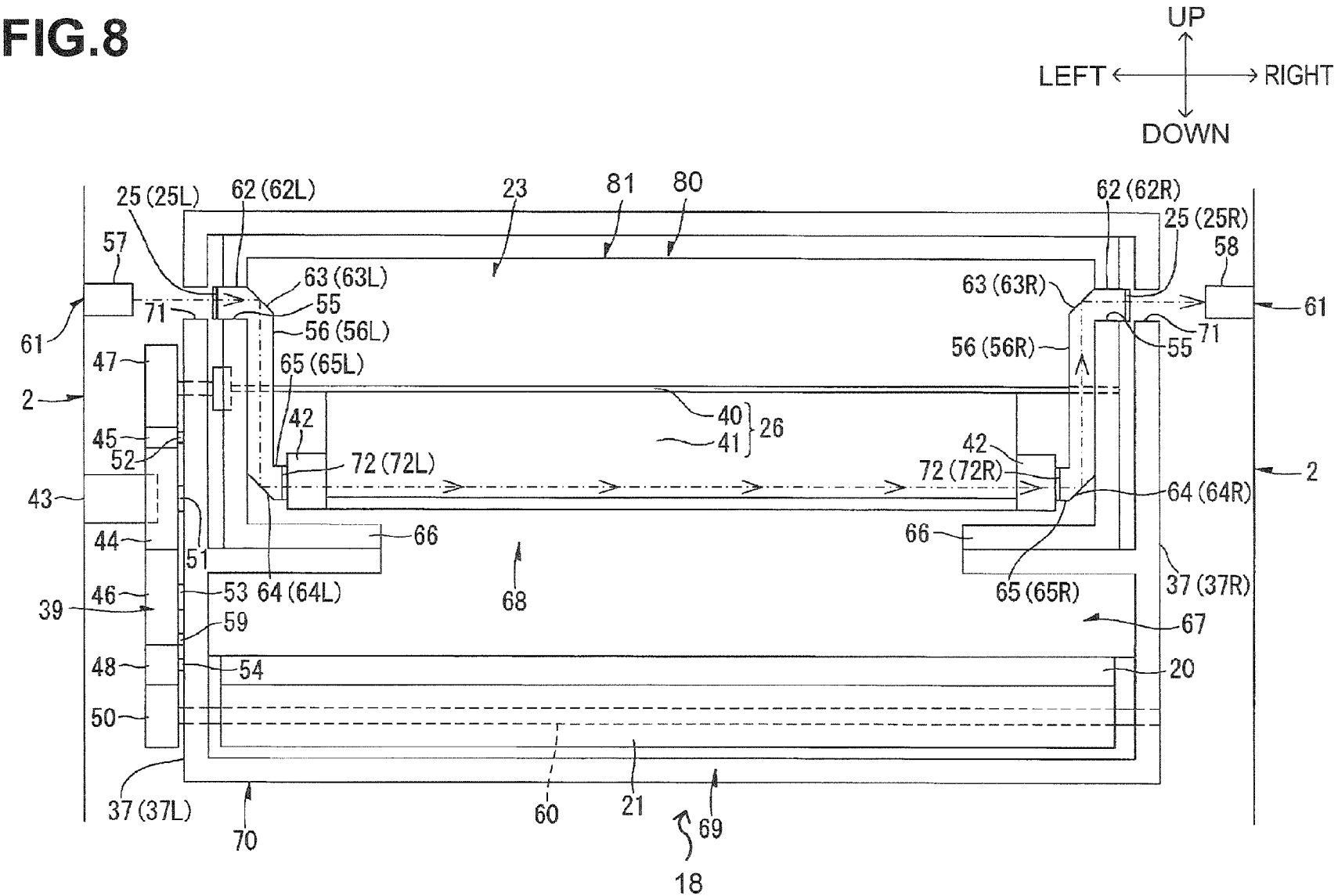
FIG. 8 represents another aspect in which a modification is made to the developer cartridge in FIG. 4.

FIG. 8 represents another aspect, example 3, in which a modification is made to the developer cartridge 18 in FIG. 4. Note that the same symbols have been added to the same parts described above, and the descriptions thereof have been omitted in FIG. 8.

In the example 3 shown in FIG. 8, the toner chamber 23 is detachable from the developing chamber 67. The toner chamber 23 includes a casing 81 of a developer cartridge 80. The developing chamber 67 includes the casing 70 of the developing cartridge 69. Outer windows 25L and 25R are formed on the casing 81. A through-hole 71 is formed on the casing 70. When the developer cartridge 80 is attached to the developing cartridge 69, the through-hole 71 is located so as to correspond with the outer windows 25L and 25R. Light from the light emitting device 57 enters the light transmitting tube 56L through the through-hole 71 and the outer window 25L. Light from the light transmitting tube 56R is received by the light receiving device 58 through the outer window 25R and the through-hole 71.

Figure 9:
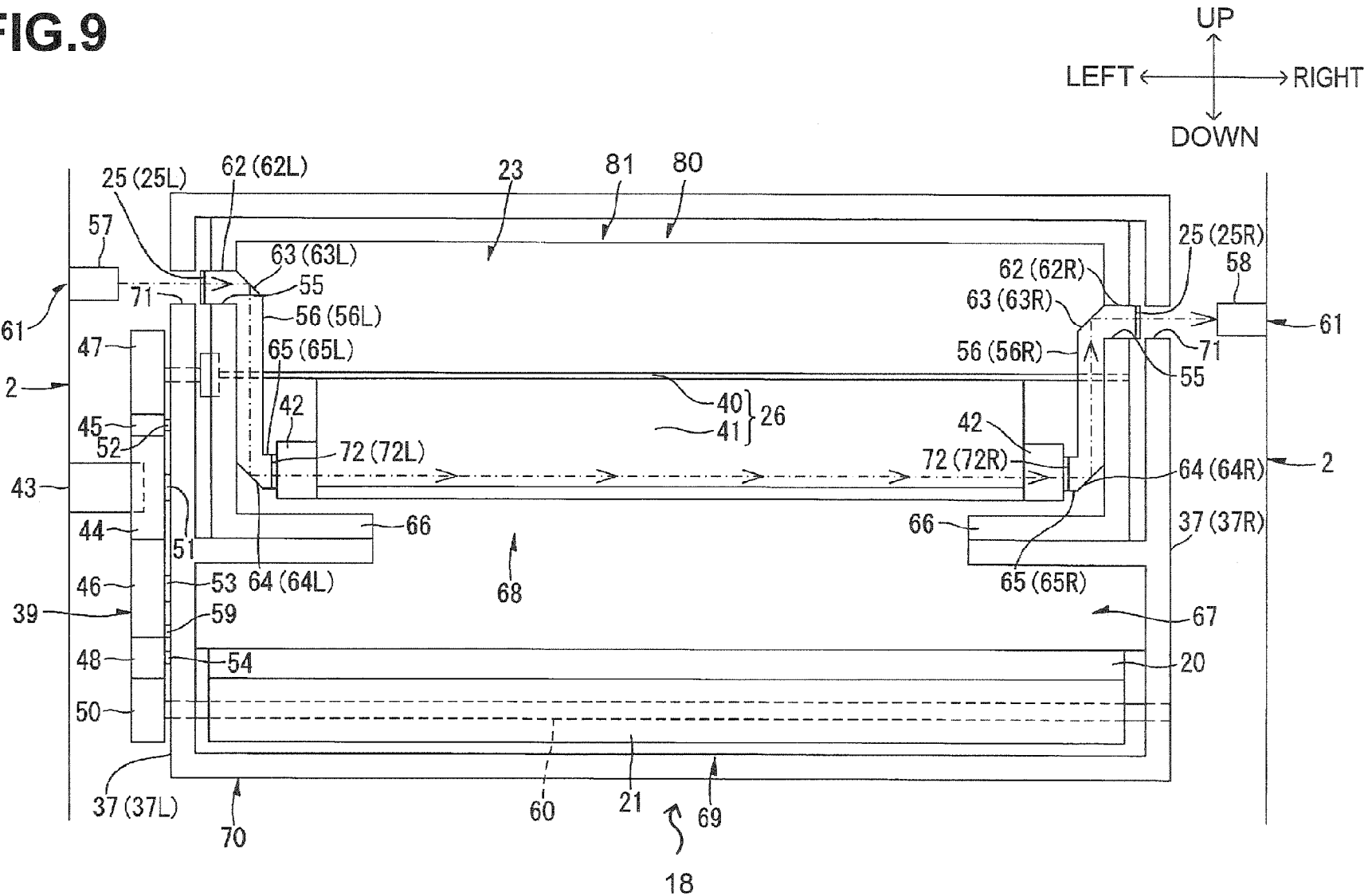
FIG. 9 represents another aspect in which a modification is made to the developer cartridge in FIG. 8.
Figure 10:
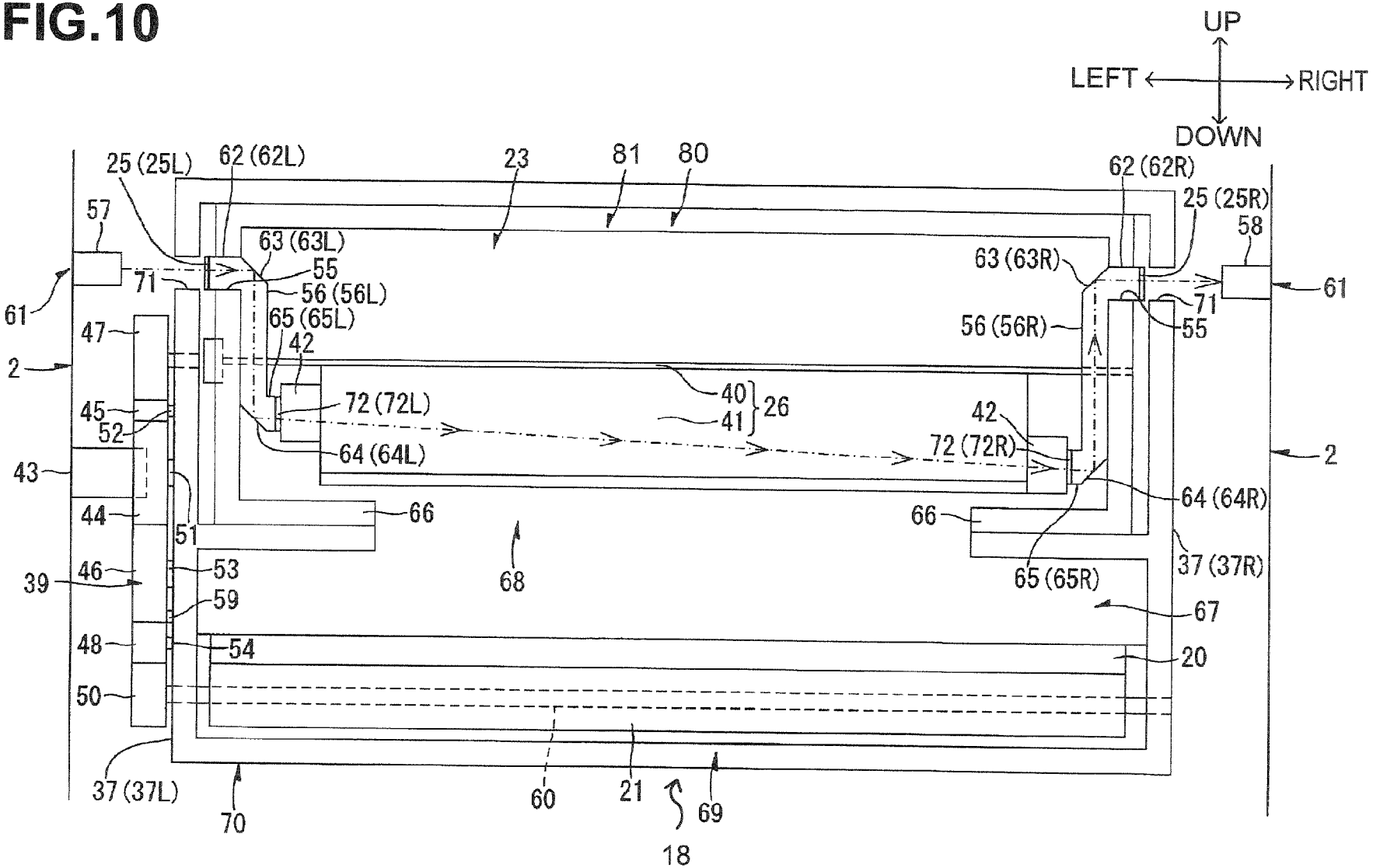
FIG. 10 represents yet another aspect in which a modification is made to the developer cartridge in FIG. 8.
Figure 11:
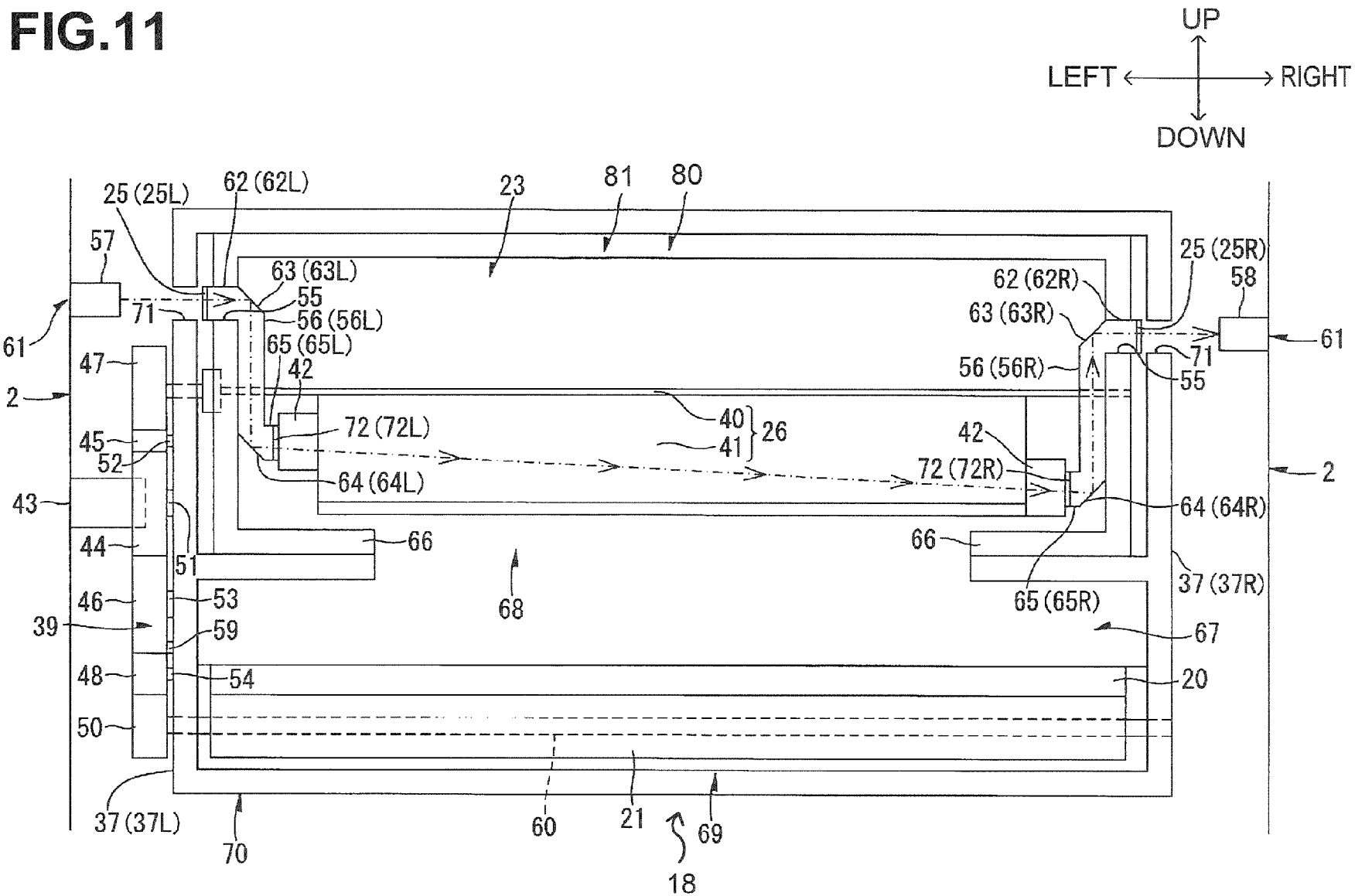
FIG. 11 represents a further aspect in which a modification is made to the developer cartridge in FIG. 8.

The above-described modification in example 1 may be applied to example 3 as such, (refer to FIG. 9) or the modification in example 2 may similarly be applied (refer to FIG. 10). Alternatively, the modifications in examples 1 and 2 may be combined and applied to FIG. 8 (refer to FIG. 11).

(4) Example 4

Figure 12:
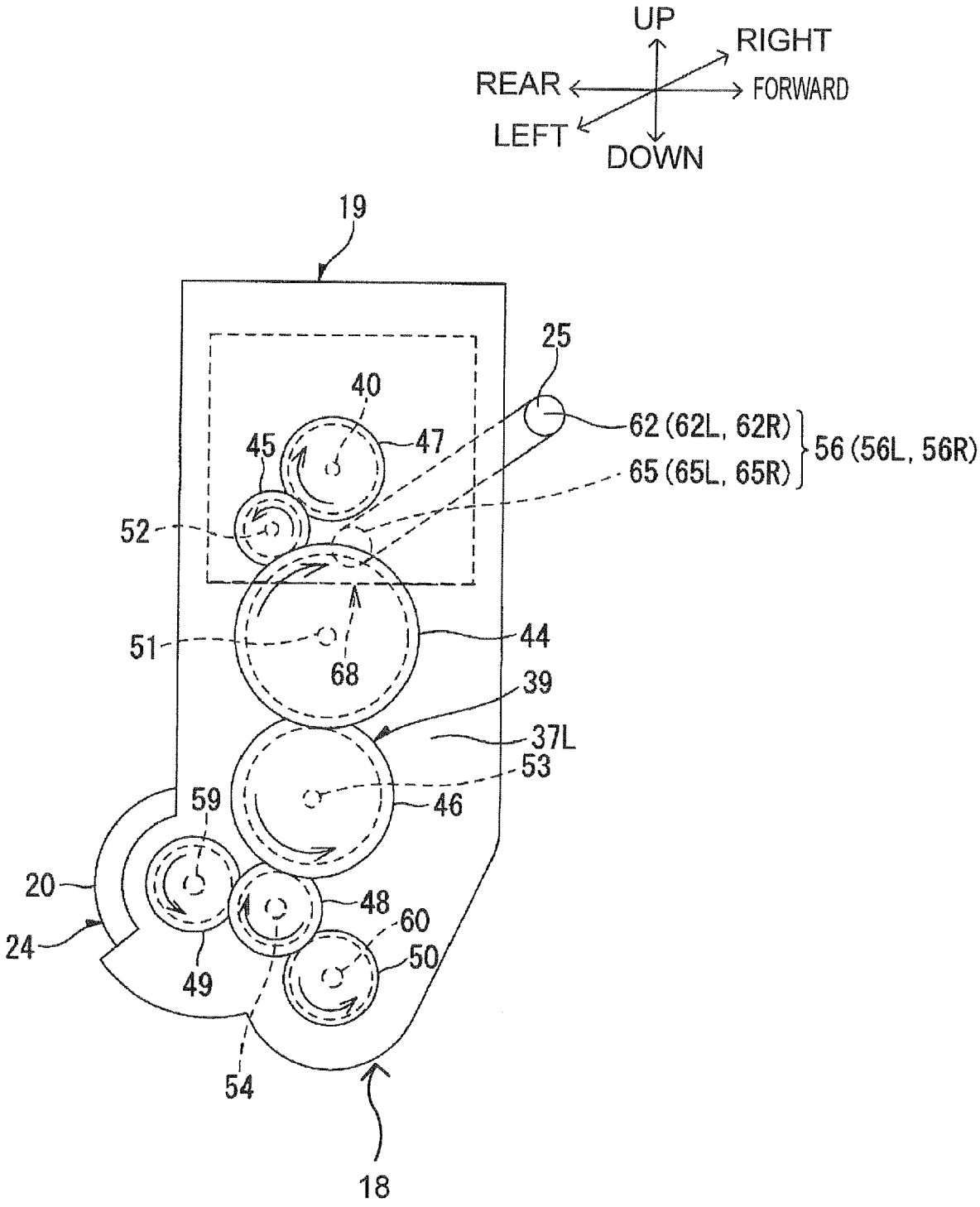
FIG. 12 represents an aspect in which a modification is made to the developer cartridge in FIG. 3.

FIG. 12 represents a further aspect, example 4, in which a modification is made to the developer cartridge 18 in FIG. 3. Note that the same symbols refer to the same parts described above, and the descriptions thereof are omitted in FIG. 12.

One edge portion 62 of the light transmitting tube 56 may be set at a position away from the developer cartridge 18 when it is projected horizontally. Alternatively, the light emitting device 57 and light receiving device 58 may be similarly set at a position away from the developer cartridge 18 when it is projected horizontally. In this case, the distance between one edge portion 62 and the other edge portion 65 is set according to the position of the edge portion 62 of each light transmitting tube 56.

With this configuration, the light emitting device 57, light receiving device 58, and one edge portion 62 can be freely set at a position away from parts such as the gear portion 39 that block light from traveling.

Thus, the color laser printer 1 and developer cartridge 18 can be configured more simply.

(5) Example 5

In the aspects and examples described above, the light transmitting tube 56 is configured as a circular tube formed with a mirror surface in which the inner circumference fully reflects light. If the light transmitting tube 56 includes optic fiber or an acrylic sheet it provides the effect of the light transmitting tube 56 described above. Furthermore, to form the light path B shown in FIG. 4, the configuration includes only a reflecting mirror to be set at the positions of the first deflecting portion 63 and the second deflecting portion 64.

(6) Example 6

In the above aspects and examples, a color laser printer 1 is shown that directly transfers an image from each photoconductive drum 16 to the paper 3. One skilled in the art will appreciate that aspects of the invention are not limited to these aspects. A type of color laser printer may be configured wherein a toner image for each color is transferred to and intermediate body once from each photoconductor, and is then transferred to paper from the intermediate body. Alternatively, a monochrome laser printer may be configured. In addition, the developer cartridge can be applied to powder developer as well as to liquid developer.

What is claimed is:

1. A developer cartridge configured to be detachably installed in an image forming apparatus in a first direction, the developer cartridge further comprising:

a casing configured to accommodate developer therein, the casing including a first sidewall and a second sidewall, the first sidewall facing the second sidewall in a second direction, the second direction intersecting the first direction;

a first light transmitting portion disposed in the first sidewall, the first light transmitting portion including a first light path configured to transmit light from outside of the casing to inside the casing, the first light path being formed to deflect the light; and a second light transmitting portion disposed in the second sidewall, the second light transmitting portion including a second light path configured to transmit light from inside the casing to outside the casing, the second light path being formed to deflect the light, wherein a first edge of the first light transmitting portion is closer to the outside of the casing and a second edge of the first light transmitting portion is closer to the inside of the casing; and a first edge of the second light transmitting portion is closer to the outside of the casing and a second edge of the second light transmitting portion is closer to the inside of the casing; and wherein the first edge of the first light transmitting portion is located in a position different from the second edge of the first light transmitting portion when the first edge of the first light transmitting portion is projected in the second direction; and the first edge of the second light transmitting portion is located in a position different from the second edge of the second light transmitting portion when the first edge of the second light transmitting portion is projected in the second direction.

2. The developer cartridge according to claim 1, wherein a first light path extending from the first edge of the first light transmitting portion to the first edge of the second light transmitting portion is parallel to the second direction, and a second light path extending from the second edge of the first light transmitting portion to the second edge of the second light transmitting portion is parallel to the second direction, and the first light path is parallel to the light path.

3. The developer cartridge according to claim 1, wherein the casing comprises a passage for releasing the developer outside the casing, and the distance from the first edge of the first light transmitting portion to the passage is longer than the distance from the second edge of the first light transmitting portion to the passage.

4. The developer cartridge according to claim 3, wherein the distance from the first edge of the second light transmitting portion to the passage is longer than the distance from the second edge of the second light transmitting portion to the passage.

5. The developer cartridge according to claim 1 further comprising an agitator in the casing, the agitator configured to rotate and including an axis supported by the casing and a mixer portion coupled to the axis, wherein the first edge of the first light transmitting portion is located on a first side of the axis and the second edge of the first light transmitting portion is located on a second side of the axis opposite the first side.

6. The developer cartridge according to claim 5, wherein the first edge of the second light transmitting portion is located on the first side of the axis and the second edge of the second light transmitting portion is located on the second side of the axis.

7. The developer cartridge according to claim 6, further comprising a gear portion that is located on the first sidewall on the outside of the casing and coupled to the axis of the agitator; and wherein the second edge of the second light transmitting portion is located in the same position as the gear portion when the second edge of the second light transmitting portion is projected in the second direction.

8. The developer cartridge according to claim 5 wherein the agitator further comprises a wiper which moves when the axis rotates, and the second edge of the first light transmitting portion and the second edge of the second light transmitting portion are located on a locus of movement of the wiper.

9. An image-forming apparatus comprising:

a housing;

a developer cartridge which is detachably installed in the housing, the developer cartridge including a casing configured to accommodate developer therein, the casing including a first sidewall and a second sidewall, the first sidewall facing the second sidewall in a second direction, the second direction intersecting the first direction, a first light transmitting portion disposed in the first sidewall, the first light transmitting portion including a first light path configured to transmit light from outside of the casing to inside the casing, the first light path being formed to deflect the light; and a second light transmitting portion disposed in the second sidewall, the second light transmitting portion including a second light path configured to transmit light from inside the casing to outside the casing, the second light path being formed to deflect the light;

a light emitting portion that is configured to emit light into the first light transmitting portion of the developer cartridge; and a light receiving portion that is configured to receive light from the second light transmitting portion of the developer cartridge;

wherein when the developer cartridge is installed in the housing, the first light transmitting portion of the developer cartridge faces the light emitting portion, and the second light transmitting portion of the developer cartridge faces the light receiving portion, wherein a first edge of the first light transmitting portion is closer to the outside of the casing and a second edge of the first light transmitting portion is closer to the inside of the casing; and a first edge of the second light transmitting portion is closer to the outside of the casing and a second edge of the second light transmitting portion is closer to the inside of the casing; and wherein the first edge of the first light transmitting portion is located in a position different from the second edge of the first light transmitting portion when the first edge of the first light transmitting portion is projected in the second direction; and the first edge of the second light transmitting portion is located in a position different from the second edge of the second light transmitting portion when the first edge of the second light transmitting portion is projected in the second direction.

* * * * *